US006958583B1

(12) United States Patent
An

(10) Patent No.: US 6,958,583 B1
(45) Date of Patent: Oct. 25, 2005

(54) AC VOLTAGE CONTROL CIRCUIT

(75) Inventor: Jason An, Kyungki-Do (KR)

(73) Assignee: Worldwide Save Energy, Inc., Inwood, NY (US)

( * ) Notice: Subject to any disclaimer, the term of this patent is extended or adjusted under 35 U.S.C. 154(b) by 0 days.

(21) Appl. No.: 10/995,917

(22) Filed: Nov. 23, 2004

(30) Foreign Application Priority Data

Aug. 13, 2004 (KR) ..... 20-2004-0023155

(51) Int. Cl.[7] ..... H05B 37/02; H01J 1/02

(52) U.S. Cl. ..... 315/291; 315/300; 315/141; 315/352

(58) Field of Search ..... 315/291, 300, 315/302, 307, 91, 141, 352–356, 360; H05B 37/02; H01J 1/02

(56) References Cited

U.S. PATENT DOCUMENTS 6,278,103 B1 * 8/2001 Takami ..... 250/214 R
6,583,574 B2 6/2003 Ann et al. ..... 315/149

* cited by examiner

*Primary Examiner*—Trinh Vo Dinh
(74) *Attorney, Agent, or Firm*—Nolte, Nolte & Hunter

(57) ABSTRACT

The inventive control circuit 40 serves to render the output voltage to be the output value of any one of the outputs OUT1 to OUT5 when both the main power source A of the power saving device 100 and the control circuit's switch B are in ON state, and to maintain the output value to be constant by the operations of the comparator, CPU or the like in the control circuit 40. In addition, if the input voltage or input current is excessively high or low, the control circuit 40 can cut off the voltage or current, so that the protection device 100 can be protected from abnormal voltage or abnormal current.

2 Claims, 4 Drawing Sheets

Prior Art

AC VOLTAGE CONTROL CIRCUIT

BACKGROUND OF THE INVENTION

1. Field of the Invention

The present invention relates to an AC voltage control circuit for controlling AC voltage in such a manner that voltage can be constantly outputted regardless of fluctuation of inputted AC voltage and in particular to an AC voltage control circuit for use in a power saving device for a discharge lamp.

2. Description of the Prior Art

Illumination apparatuses using light obtained from the discharge of gas filled in the apparatuses after the gas has been electrically discharged, such as fluorescent lamps, mercury lamps, and metal lamps, are generically named as "discharge lamp". Such discharge lamps generally require predetermined level of voltage such as 120V or 277V so as to initiate the discharge. However, once the discharge is produced and thus the lamps are turned to ON, they can emit light without any difficulty even if voltage lower than the predetermined voltage is applied so as to maintain the discharge.

For example, in the case of a large-scaled signboard employing 100 to 300 sodium-vapor lamps at one time, voltage in the range of about 80 to 90% of initial voltage may be applied to the signboard at the discharge maintaining step. In such a case, a great power saving effect can be achieved.

As an example of power saving devices exhibiting such a power saving effect, one power saving device is known, which first applies 120V (or 277V) to a discharge lamp so that discharge is initiated in the discharge lamp when the discharge lamp is turned ON. It then applies minimum discharge maintaining voltage lower than the discharge initiating voltage to the discharge lamp after the discharge is completed, thereby producing a power saving effect, wherein the minimum discharge maintaining voltage is the minimum voltage applied to the discharge lamp at which the discharge lamp can emit light with a predetermined level of illumination and/or brightness required for humans. FIG. 1 shows one example of such a power saving device of the prior art.

The power saving device 100 for a discharge lamp shown in FIG. 1 has a pair of coils C1, C2, which are wound in different directions, and an insulation member INS interposed between the coils C1, C2, wherein the pair of coils C1, C2 serve as a compound transformer with subtractive polarity and the coils C1, C2 generates inducted voltage. The circuit has first and second switches S1, S2 and the secondary coil is provided with a plurality of taps T1, T2, T3, and T4. As indicated dotted lines, a pair of terminals P1, P2 are connected to an external power source E and another pair of terminals P3, P4 are connected to the discharge lamp L.

At the initial step for lighting the discharge lamp, the first switch S1 is closed and the second switch S2 is opened, in which if the discharge lamp L is lighted by primary voltage applied from the external, the second switch S2 is connected with one of the plural taps T1, T2, T3 and T4 by a timer 14 connected with the first and second switches S1, S2 and the first switch S1 is opened. Thereafter, the induction voltage induced in the coils C1, C2 is transferred to the discharge lamp, thus maintaining the continuous lighting of the discharge lamp, wherein the induction voltage induced in the coils C1, C2 is lower than the primary voltage. Therefore, a power saving effect can be obtained.

On the other hand, such a power saving device for a discharge lamp also requires a voltage regulator which can supply constant and stable output voltage regardless of fluctuation of voltage inputted into the power saving device 100. A conventional automatic voltage regulator (AVR) essentially consists of a multi-tap transformer and a switch. The automatic voltage regulator senses fluctuation of the output voltage and is adapted to render predetermined voltage to be outputted by intermitting the multi-taps of the transformer using a semiconductor switching device, or the like, depending on the fluctuated output voltage sensed by the regulator.

In addition, the conventional power saving device for a discharge lamp shown in FIG. 1 further includes a protection device against abnormal voltage, an over-current cut-off device, or the like for preventing voltage and current flowing in the power saving circuit from being increased over or decreased below a normal value, as well as the above-mentioned automatic voltage regulator. Moreover, as shown in FIG. 1, the conventional power saving device further includes a timer 14 connected to the switches S1, S2, as well as a display device for informing a user of the voltage or current in the power saving device circuit. Eventually, the conventional power saving device 100, as being practically used, is separately provided with numerous additional circuits at the input side and/or output side of the power saving device 100 beyond the basic circuit structure shown in FIG. 1. Therefore, the entire volume of the power saving device and manufacturing costs thereof are increased. Furthermore, because numerous additional circuits are individually provided, inconvenience in maintaining and controlling such a power saving device follows, from a user's standpoint.

SUMMARY OF THE INVENTION

Accordingly, the present invention has been conceived to solve the above-mentioned problems occurring in the prior art, and an object of the present invention is to provide an AC voltage control circuit that comprises a voltage regulator having a power saving effect higher than that of a conventional voltage regulator and incorporates all the components, such as:

an abnormal voltage protection device,
an over-current cut-off device,
various monitoring devices, thereby enabling the circuit structure of the power saving device to be simplified and the volume and manufacturing costs of the power saving device to be reduced as well as allowing a user to easily and conveniently maintain and control such a power saving device.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings.

Figure 1:
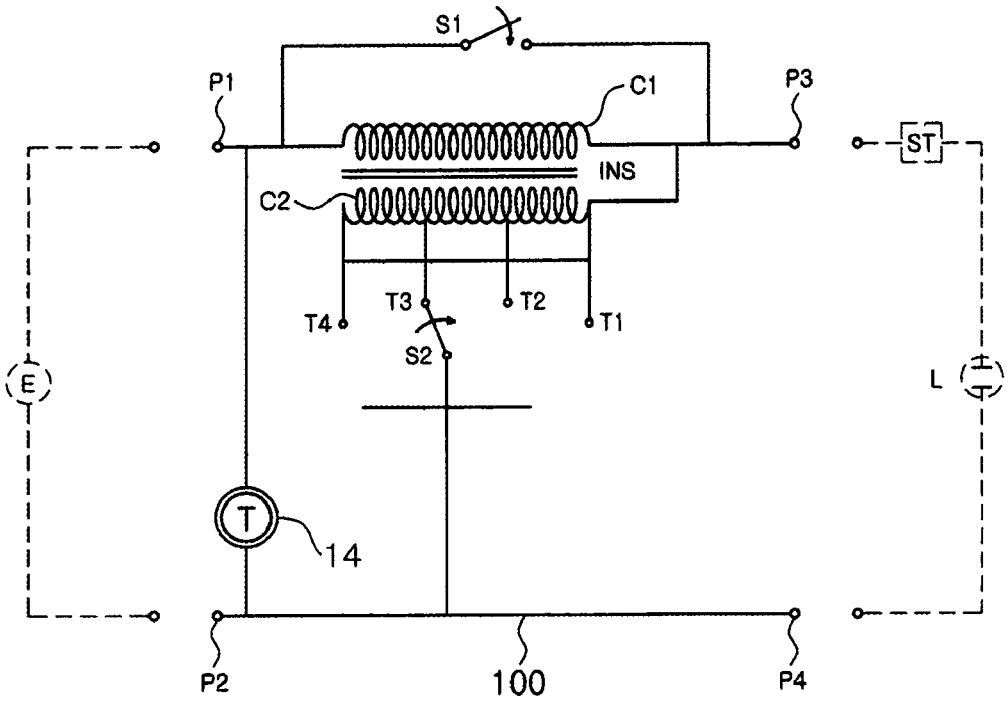
FIG. 1 is a schematic view showing a conventional power saving device for use in a discharge lamp.
Figure 2:
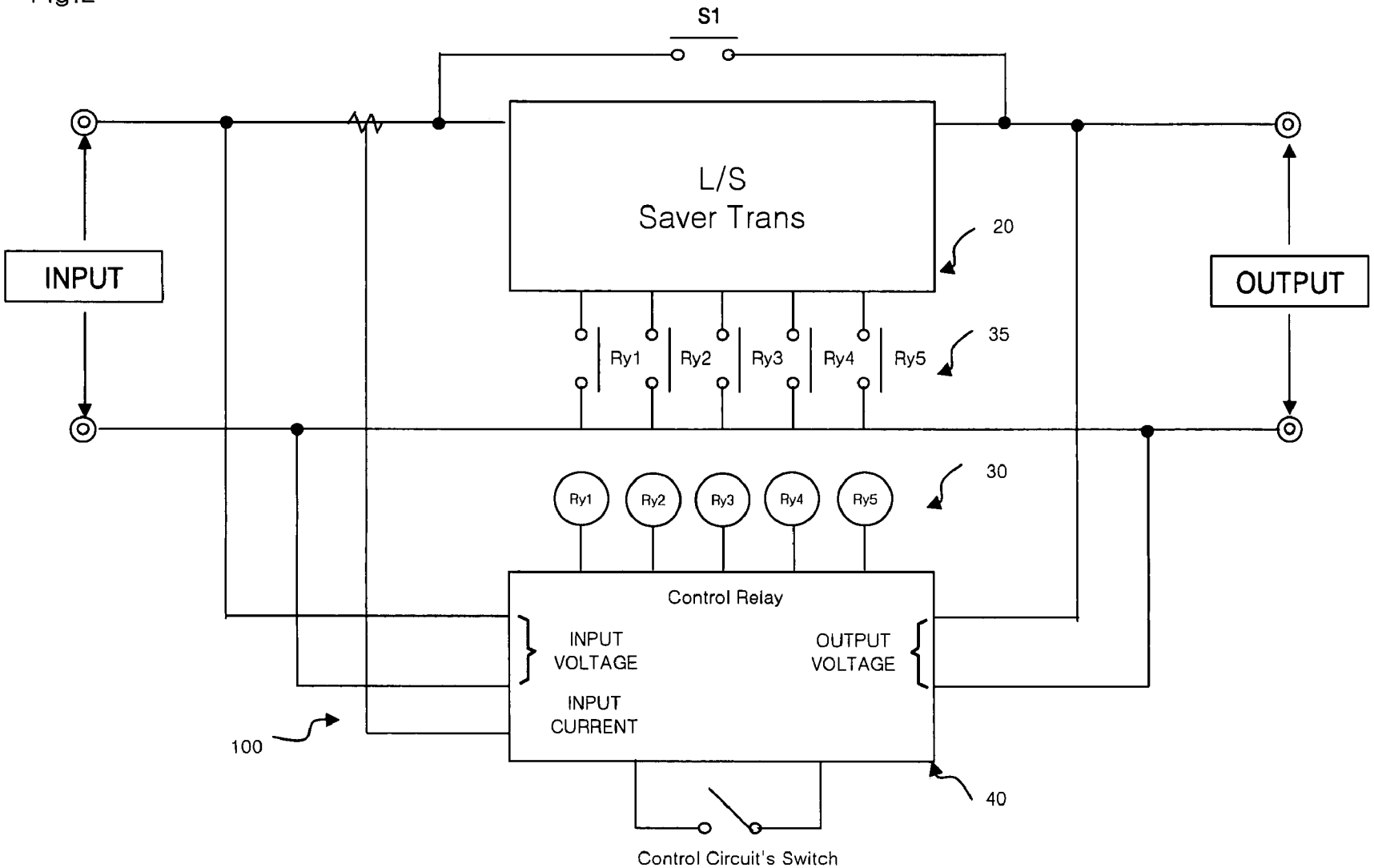
FIG. 2 is a schematic view showing a power saving device provided with an AC voltage control circuit according to the present invention.

FIG. 2 shows a power saving device 100 for use in a discharge lamp, which incorporates the inventive AC voltage control circuit 40. As compared with FIG. 1, the switch S1, the transformer consisting of a pair of the coils C1, C2, and the switch S2 capable of being connected to the plural taps T1 to T4 in FIG. 1 correspond to a relay contact S1, a transformer 20 and contacts 35, respectively. However, means for specifically implementing the switch, transformer, etc. can be implemented in any existing manner. For example, the present invention shown in FIG. 2 may employ the switch S2 like that shown in FIG. 1, in lieu of the relay contacts 35.

As shown in FIG. 2, the AC voltage control circuit 40 is supplied with input voltage, input current and output voltage of the power saving device 100 and controls the contacts 35 of the relays 30 based on the inputted values, so that the power saving device 100 can output target output voltage. As shown in the drawing, the input voltage terminal and input voltage terminal of the control circuit 40 are connected to the input stage of the power saving device in parallel and in serial, respectively, and the output voltage terminal is connected to the output stage of the power saving device 100 in parallel. As described above, the conventional power saving device of FIG. 1 is separately provided with protection devices for protecting the power saving device 100 from abnormal voltage and over-current, including the timer 14 to be used in sequentially opening and closing the switches S1, S2 depending on time. Whereas, according to the present invention, all the components, such as a timer, an abnormal voltage protection device, and an over-current cut-off device, are incorporated in the control circuit 40.

Figure 3:
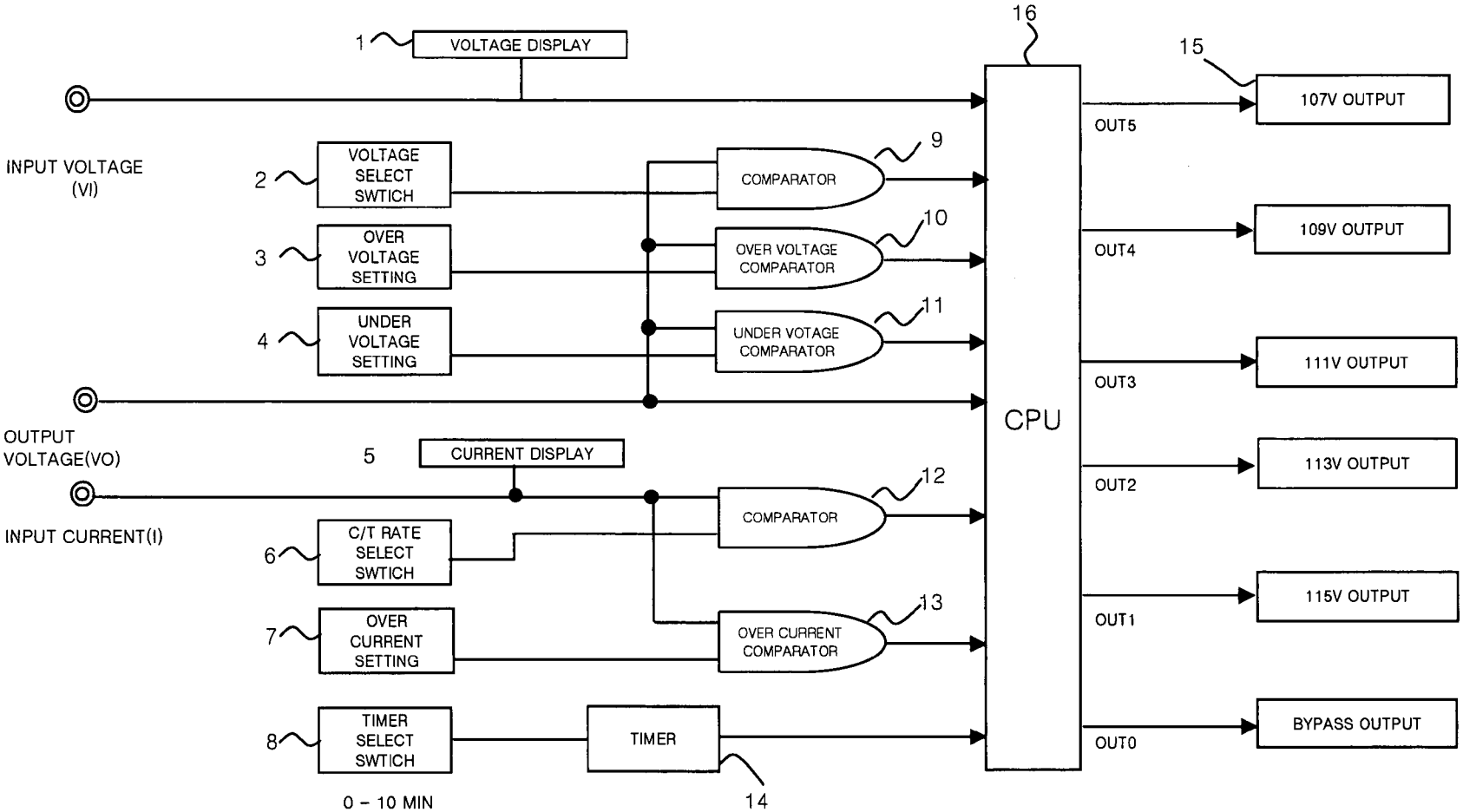
FIG. 3 is a block diagram of the AC voltage control circuit according to the present invention.

FIG. 3 shows the internal configuration of the AC voltage control circuit 40 in a block diagram.

The voltage V1 inputted from the input stage of the power saving device 100 is transferred to a voltage display 1 in the control circuit 40, thereby showing the present input voltage condition of the power saving device 100 to the user. The voltage display 1 may be implemented in either analogue type or digital type.

The user may set target output voltage as desired by the user by operating a voltage selection switch 2. For example, if the voltage inputted into the power saving device 100 is 120V, the user can optionally set the target voltage to be outputted by the power saving device 100 to 115V, 110V, etc. In addition, in order to prevent high voltage unendurable by the power saving device 100 from being unexpectedly applied to the circuit in the power saving device 100, the user can set the maximum permissible voltage through an over-voltage setting device 3. Likewise, the user can also set the minimum permissible voltage value using an under-voltage setting device 4. The user can directly operate the over-voltage setting device 3 and the under-voltage setting device 4 to set the permissible voltage range of the power saving device 100. Alternatively, the voltage values can be automatically set by the voltage setting devices 3, 4 or fixed to predetermined ones.

The voltage VO inputted from the output stage of the power saving device into the control circuit 40 (FIG. 2) is respectively inputted into a voltage comparator 9 (FIG. 3), an over-voltage comparator 10, and an under-voltage comparator 11. The output voltage VO is compared with the target output voltage set by the user in the voltage comparator 10, and a CPU 16 controls in such a manner that the output voltage VO is outputted as any one of OUT1 to OUT5 depending on the result of comparison. The ON/OFF of each output OUT1 to OUT5 is determined depending on how the respective contacts 35 are opened or closed. In the present embodiment, the output OUT1 of FIG. 3 means the output in the state in which the contact Ry1 in the contacts 35 of FIG. 2 is closed. Likewise, each output OUT2 to OUT5 means the output in the state in which only one corresponding contact among the contacts Ry2 to Ry5 is closed. For example, if the user set the output voltage to 115V in the initial driving step of the control circuit 40, all the remaining relay contacts except the contact Ry2 among the relay contacts 35 are opened and only the contact Ry2 is closed, so that the power saving device 100 can output 115V.

The bypass output in FIG. 3 means that the input voltage of the power saving device 100 is outputted directly to the output without passing through the transformer 20. In addition, in the present embodiment, the outputs OUT1 to OUT5 are set to have voltage values 115V, 113V, 111V, 109V and 107V, respectively, and thus it can be said that the respective output stages have a tolerance of ±1.0V.

The over-voltage comparator 10 compares the output voltage VO with the voltage value set in the over-voltage setting device 3, and can turn the power source of the power saving device 100 OFF or cut off the circuit by controlling the CPU 16 if the output value VO exceeds the set voltage value. Likewise, the under-voltage comparator 11 compares the output voltage VO with the voltage value set in the under-voltage setting device 4.

The input current I inputted from the power saving device 100 into the control circuit 40 is displayed on the current display 5 and the user can be informed of the status of present input current. The current display 5 can be implemented in either analogue type or digital type.

The over-current comparator 13 compares the input current I with the current value set in the over-current setting device and transfers the result of comparison to the CPU 16. As a result of comparing the currents, if it is determined that the current flowing into the power saving device 100 exceeds the range of current to be capable of being received by the power saving device 100, the CPU 16 cuts off the current flowing into the power saving device 100, so that the power saving device 100 and the control circuit 40 can be protected from the over-current.

The timer 14 and the timer selection switch 8 of FIG. 3 have same functions with the conventional timer 14 (shown in FIG. 1) and switch (not shown), respectively. The conventional timer is separately mounted in the circuit of the power saving device, whereas according to the present invention, the timer and timer selection switch are incorporated in the control circuit 40.

The inventive control circuit 40 described above compares the target output voltage with the output voltage VO in the voltage comparator 9 and if it is determined that the output voltage is higher or lower than the target voltage value beyond a range of permissible tolerance, the CPU 16 controls the open/close state of the contacts 35 of the relays 30 in such a manner that the output voltage VO can be outputted within the range of permissible tolerance.

For example, it is assumed that the present input voltage of the power saving device 100 is 120V and the user sets the target voltage to 113V. Because the target output voltage is set to 113V, all the remaining contacts except the contact Ry2 among the relay contacts 35 are opened and only the contact Ry2 is closed. At this time, if a situation in which the practical input voltage is lower than 120V occurs, the voltage practically outputted from the power saving device 100 will not be 113V but lower than 113V (assumed as 111V). The comparator 9 then determines that the actual output voltage VO is lower than the target voltage by 2V, and the CPU 16 controls the contact Ry2 to be opened and the contact Ry1 to be closed so as to increase the output voltage by 2V, whereby the resultant output voltage VO can be maintained at 113V. In contrast, if the target output voltage is 113V and the practical output voltage is 115V, the CPU 16 controls the contact Ry2 to be opened and the contact Ry3 to be closed so as to reduce the output voltage by 2V, whereby the output voltage of 113V can be maintained.

Figure 4:
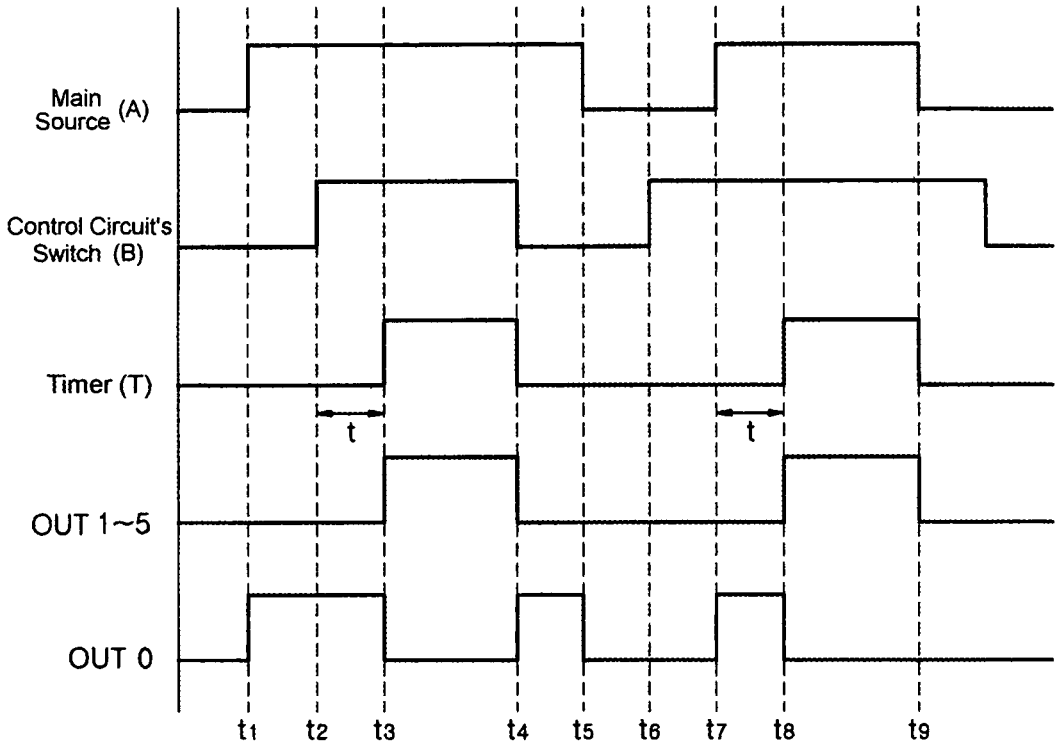
FIG. 4 is a timing chart illustrating the operation of the AC voltage control circuit according to the present invention.

The operation of the inventive control circuit 40 described above can be indicated by a timing graph as in FIG. 4. In the graph, the main power source A is a source for supplying power to the power saving device 100, and the control circuit's switch B means the initiation of operation of the control circuit 40. The ON/OFF of the main power source A and the control circuit's switch B can be performed in such a manner that the switch is attached to the power saving device 100 and the control circuit 40, and the main power source and the control circuit's switch are turned to ON/OFF. However, where such a switch does not exist, if the input voltage is applied to the input stage of the power saving device 100, the main power source A is in ON state, whereas if the input voltage is not applied, the main power source A is in OFF state. This can be identically applied to the control circuit 40.

There will be four kinds of ON/OFF combinations between the ON/OFF of the main power source A and the ON/OFF of the control circuit's switch B, wherein FIG. 4 shows how the outputs of the timer T and the control circuit operate respectively. At first, if voltage is applied to the power saving device 100 at t1 (i.e., the main power source A is turned to ON), the output voltage VO will be bypass output OUT0 because the control circuit's switch B is not in ON state. Thereafter, if the user turns the control circuit's switch B to ON state at t2, the timer T in the control circuit 40 starts to operate and the power saving device 100 will enter into the power saving mode at t3 after a predetermined time period t passes. That is, the output voltage VO of the power saving device 100 becomes an output value pre-selected by the user among the outputs OUT1 to OUT5. During the period t3 to t4, the power saving device 100 constantly remains in the power saving mode, and the output voltage VO and the target output voltage are continuously compared by the comparator 9 in the control circuit 40 every predetermined time period, in which the output voltage VO is maintained at a predetermined value and outputted under the control of the CPU 16 even if the input voltage VI is fluctuated.

If the control circuit's switch B is turned to OFF at t4 by the user or due to another reason, the timer T stops its operation and the output voltage VO becomes the bypass output, whereby the input voltage VI applied to the power saving device 100 is outputted as the output voltage VO as it stands. Thereafter, if the main power source A is also turned to OFF at t5, no voltage is applied to the power saving device 100. Therefore, the output voltage VO will be zero.

In a different case, another status can be assumed, in which the control circuit's switch B is turned to ON prior to the main power source. That is, the control circuit's switch B is firstly turned to ON at t6. However, because the power saving device 100 is still in an OFF state, the output voltage VO is still zero, and if the power saving device 100 is turned to ON at t7, the bypass output OUT0 is outputted until the timer T starts to operate and enters into the power saving mode. If time t has passed after the timer T started to operate, the device 100 is in the power saving mode, and the output voltage VO of the power saving device 100 becomes an output value pre-selected by the user among the outputs OUT1 to OUT5. During the period t8 to t9, the power saving device 100 operates in the power saving mode, and as in the period t3 to t4, the control circuit 40 compares the output voltage and the target output voltage in the comparator 9 every predetermined time period, and maintains and outputs the output voltage VO at a predetermined value under the control of the CPU 16 even if the input voltage fluctuates. Thereafter, if the main power source is turned to OFF at t9, the output voltage VO is zero even if the control circuit's switch B is in an ON state.

As described above, the inventive control circuit 40 serves to render the output voltage to be any one of the outputs OUT1 to OUT5 when both the main power source A of the power saving device 100 and the control circuit's switch B are in an ON state and to maintain the output value to be constant by the operations of the comparator, CPU or the like in the control circuit 40. In addition, if the input voltage or input current is excessively high or low, the control circuit 40 can cut off the voltage or current so that the power saving device 100 can be protected from abnormal voltage or abnormal current.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the detailed description of the present invention and accompanying drawings shall not be considered as limiting but merely exemplifying the idea of the present invention.

What is claimed is:

1. An AC voltage control circuit for use in a power saving device for a discharge lamp, wherein the AC voltage control circuit comprises:

a first voltage terminal supplied with the voltage of an output stage of the power saving device;

a current terminal supplied with the current of the power saving device;

a first comparator for comparing the input voltage of the first voltage terminal and a predetermined target output voltage;

a second comparator for comparing the input voltage of the first voltage terminal and a predetermined permissible voltage;

a third comparator for comparing the input current of the current terminal and a predetermined permissible current;

a central processing unit connected to the first, second and third comparators, so that the central processing unit controls the output voltage of the power saving device according to the result of voltage comparison of the first comparator and controls the power saving device to be protected from abnormal voltage and current according to the results of the voltage comparison of the second comparator and the current comparison of the third comparator;

a switching means for converting the output voltage of the power saving device under the control of the central processing unit; and a timer connected to the central processing unit.

2. The AC voltage control circuit as claimed in claim 1, further comprising:

a second voltage terminal supplied with the voltage of the input stage of the power saving device;

a voltage display means for displaying the voltage value of the second voltage terminal; and a current display means for displaying the current value of the current terminal.

* * * * *